United States Patent [19]

Martin

[11] 4,214,378

[45] Jul. 29, 1980

[54] MACHINE FOR DRYING AND BUTT-JOINTING WOOD VENEER BY CONTINUOUS CONTACT ENGAGEMENT

[76] Inventor: Jean-Marie M. Martin, 23, rue de Turin, Paris 8eme, France

[21] Appl. No.: 970,897

[22] Filed: Dec. 19, 1978

[30] Foreign Application Priority Data

Dec. 22, 1977 [FR] France ..... 77 38743

[51] Int. Cl.[2] ..... F26B 13/12

[52] U.S. Cl. ..... 34/148; 34/162; 156/304.1; 156/504

[58] Field of Search ..... 100/151, 152, 153, 154, 100/118, 119, 120; 144/281 B; 34/95, 148, 151, 152, 153, 162, 163; 156/304, 502, 504

[56] References Cited

U.S. PATENT DOCUMENTS

| | | | |
|---|---|---|---|
| 2,071,999 | 2/1937 | Dike | 144/281 B |
| 2,142,932 | 1/1939 | Beard | 144/281 B |
| 2,720,231 | 10/1955 | Hessler et al. | 144/281 B |
| 2,960,023 | 11/1960 | Greiner et al. | 100/152 |
| 3,003,541 | 10/1961 | Prentice et al. | 156/304 X |
| 3,669,804 | 6/1972 | Clausen et al. | 156/304 X |
| 3,907,473 | 9/1975 | De Mets | 100/151 X |
| 3,963,555 | 6/1976 | Zweig | 156/304 X |

FOREIGN PATENT DOCUMENTS

| | | | |
|---|---|---|---|
| 1054694 | 4/1959 | Fed. Rep. of Germany | 144/281 B |

*Primary Examiner*—Albert J. Makay
*Assistant Examiner*—Harold Joyce
*Attorney, Agent, or Firm*—Karl W. Flocks

[57] ABSTRACT

A machine for drying and/or jointing by continuous contact engagement wood veneers fed by being unwound or sectioned, in which shearing forces are minimized and wherein the veneers are restrained and conveyed between facing and adjoiningly juxtaposed active runs of alternating endless chains of heating interarticulated elements pertaining to input and output conveyors, first and second pressure applicators such as slidable weighty elements adjustably pressed against rollers on the chains and operating selectively and respectively at the entrance of the input conveyor and at the exit of the output conveyor, the input conveyor being driven more quickly than the output conveyor, so that each veneer is urged longitudinally against the preceding one.

5 Claims, 7 Drawing Figures

MACHINE FOR DRYING AND BUTT-JOINTING WOOD VENEER BY CONTINUOUS CONTACT ENGAGEMENT

BACKGROUND OF THE INVENTION

The present invention relates to a machine for drying and/or butt-joining "green" or "non-green" wood veneer by continuous contact engagement, said veneer being fed by being unwound or sectioned and offered up in the direction of the wood grain or in a direction perpendicular thereto.

Currently known in this field are drying and jointing machines in which the veneer is restrained and conveyed between two thin metal conveyor belts, heating skids resting by their own weight on the upper belt, which travels faster than the lower belt, which lower belt is supported by fixed heating plates, the heating skids and plates forming successive sections operating at decreasing temperatures.

Also known are machines in which the conveyor belts are formed of a plurality of successive sections that are entirely independent of one another from the standpoints of drive, rate of travel and temperature, each section being formed by a plurality of juxtaposed longitudinal strips and the passage from one section to the next being obtained by a longitudinal interpenetration or offset of the strips.

Likewise known are machines in which the thin conveyor belts are replaced by chains made up of thin or comparatively thick pallets the heating or cooling of which may be effected on the return runs of the chains.

Although the shrinkage phenomena can be reasonably well controlled in the above-mentioned machines, firstly because the upper belt travels faster than the lower belt and secondly because the belts of one section travel faster than the belts of the next section, certain drawbacks are nonetheless inherent in this type of machine.

In the first place, restraining of the veneer is imperfect in the zone of transfer from one section to the next owing to the fact that the veneer is restrained by only half of the chains. Secondly, a risk exists that the veneer may shear at the place where it suddenly passes from one section to the next section, the rate of travel of which is markedly slower. The totality of the forward thrust being transmitted by the fastest section must then be absorbed by the veneer at the level of a single transverse line, which accordingly becomes a preferred line of possible shearing.

SUMMARY OF THE INVENTION

It is the object of this invention to overcome the above-mentioned drawbacks and to provide a solution to these problems by making it possible to construct a machine in which the shearing force is distributed over the entire surface of the veneer instead of being exerted along a single transverse line.

More specifically, this invention is embodied essentially in a machine for drying and butt-jointing unwound or sectioned wood veneer by continuous contact engagement, in which an effective drying and jointing zone is defined and which includes an input conveyor and an output conveyor which are driven independently and are formed respectively by an upper set and a lower set of endless chains made up of interarticulated elements, said chains each having an active run and a return run and being driven simultaneously by sprockets and running over rollers on supporting guide-rails their facing active runs compressing and conveying the veneer while their runs are heated, said machine having the input and output conveyors adjoiningly juxtaposed in said effective drying and jointing zone in the form of groups of active runs of alternating chains belonging to each of said conveyors, arranged in an even number of chains in one conveyor and an odd number of chains in the other conveyor, first pressure means being provided at the entrance to the effective zone, straight above the chains of said input conveyor, and second pressure means being provided at the exit from said effective zone, straight above the chains of said output conveyor, the input conveyor being driven at a higher speed than the output conveyor.

The invention is also embodied in a machine of the aforementioned type, in which the articulated elements of the endless chains are constituted by blocks having a massive portion and a supporting portion, each line of said chains comprising two identical blocks made of a good heat-conducting material, the massive portion of each of which exhibits longitudinal asymmetry, the two massive portions being mounted head to tail adjoiningly and the supporting portion of each of which exhibits vertical-axis symmetry, each half supporting-portion being mounted, together with the half supporting-portion of a block belonging to the next link, on the corresponding half of a transverse hinge-pin, between a narrow supporting lateral roller and a wide supporting and driving middle roller which imparts drive responsively to the sprockets of the associated conveyor.

BRIEF DESCRIPTION OF THE DRAWINGS

The description which follows with reference to the accompanying non-limitative exemplary drawings will give a clear understanding of how the invention can be carried into practice.

In the drawings.

DESCRIPTION OF THE PREFERRED EMBODIMENTS

Figure 1:
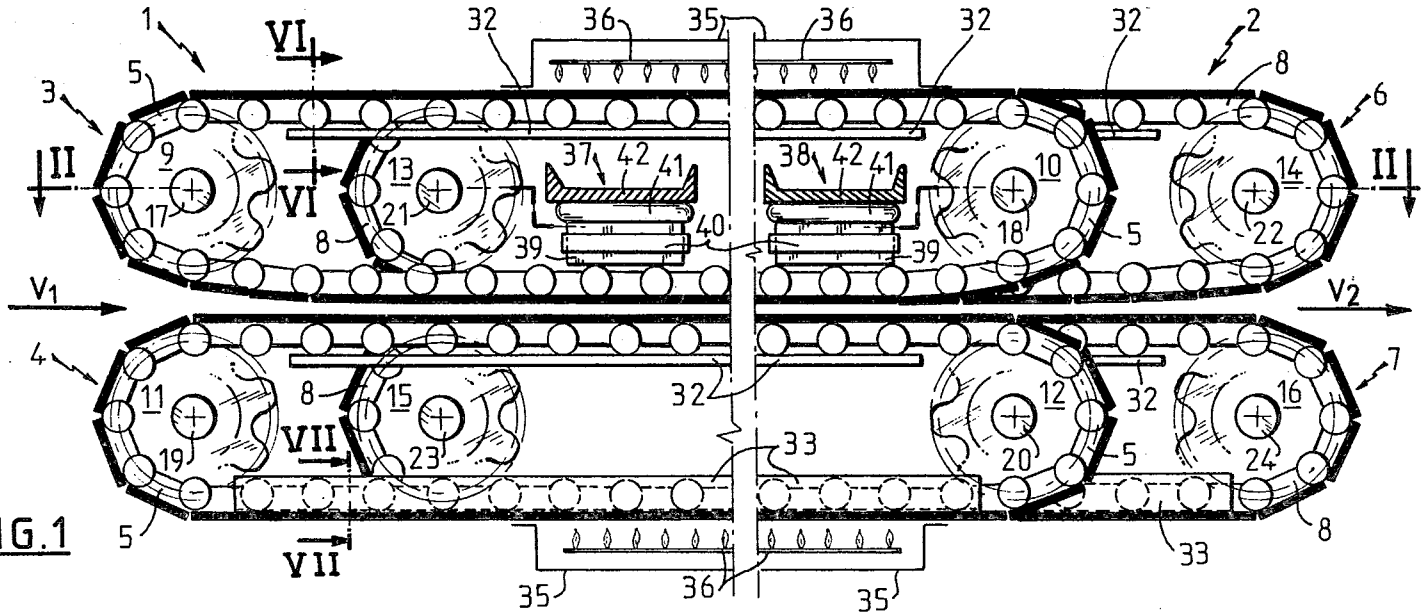
FIG. 1 is a side elevation view on a smaller scale of a preferred embodiment of the subject machine of the invention.

Referring first to FIG. 1, there is shown thereon a preferred embodiment of a machine according to this invention, which includes an input conveyor and an output conveyor generally designated by reference numerals 1 and 2 respectively. Input conveyor 1 is formed of upper and lower sets 3 and 4 of endless chains 5, and output conveyor 2 is formed of upper and lower sets 6 and 7 of endless chains 8.

Figure 2:
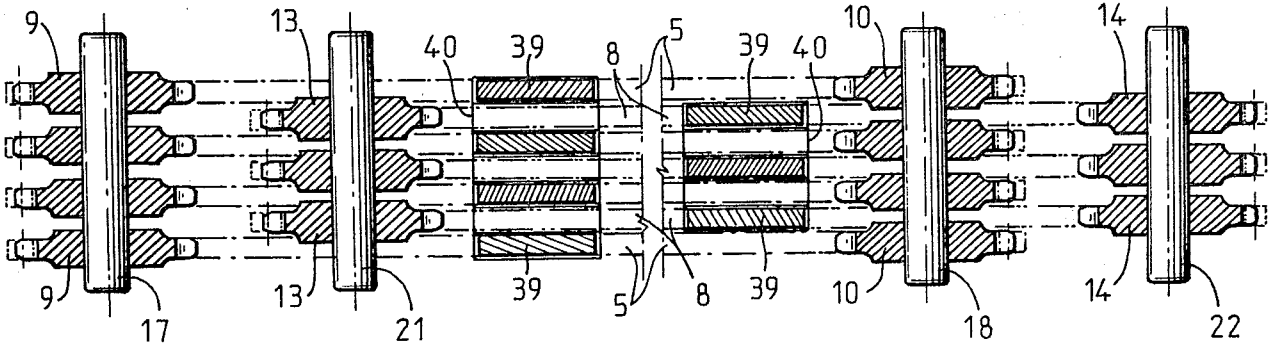
FIG. 2 is a sectional view of the machine taken on the line II—II of FIG. 1.

As is more clearly shown in FIG. 2, the input conveyor has four endless chains and the output conveyor has three endless chains. In accordance with this invention, one of the conveyors has an even number of chains and the other conveyor an odd number, the numbers of chains shown on FIG. 2 being given by way of example only. It is an essential feature of this invention that the chains of one conveyor alternate adjoiningly with those of the other along an effective drying and jointing zone of the machine. Externally to this effective zone, which is the zone of juxtaposition of the chains in the middle of the machine, the chains wrap around drive sprockets belonging respectively to the input and output conveyors.

More specifically, chains 5 and 8 of the two conveyors are respectively driven, in respect of input conveyor 1, by upper sprockets 9, 10 and lower sprockets 11, 12 and, in respect of output conveyor 2, by upper sprockets 13, 14 and lower sprockets 15, 16. All these sprockets are naturally fixedly mounted on respective drive shafts 17, 18, 19, 20, 21, 22, 23, 24.

Thus the chains 5 in the upper and lower sets 3 and 4 of input conveyor 1 are driven simultaneously at a speed $V_1$ corresponding to the speed of input of the veneer, while the chains 8 of the upper and lower sets 6 and 7 of output conveyor 2 are driven simultaneously at a speed $V_2$ corresponding to the output speed of the veneer.

Figure 3:
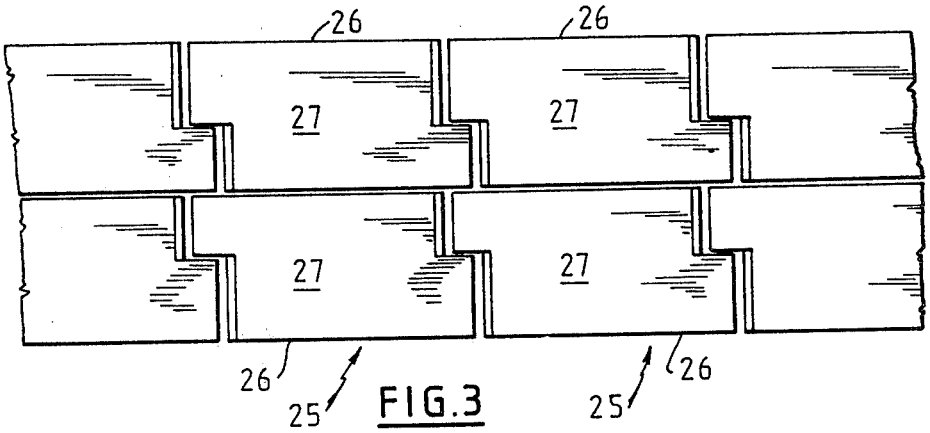
FIG. 3 is a top view of a preferred embodiment of a chain usable in the machine shown in FIGS. 1 and 2.
Figure 4:
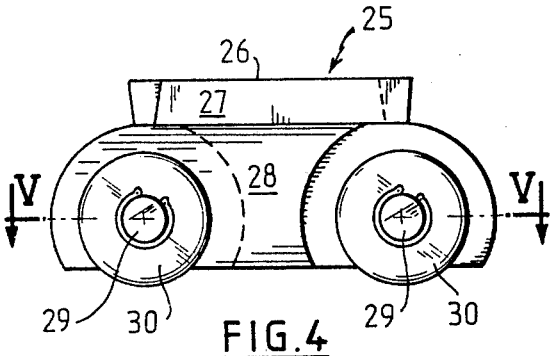
FIG. 4 is a side elevation view of link of the chain which is visible in FIG. 3.

Reference is now had to FIG. 3, which is a top view of a preferred embodiment of a block-chain intended for a machine according to the invention and one link 25 of which is depicted in greater detail in FIGS. 4 through 7. These figures show that each link 25 basically comprises two identical blocks 26 the massive part 27 of each of which exhibits longitudinal asymmetry, these two massive parts being mounted head to tail alongside each other. Each block 26 further includes a supporting portion 28 which exhibits a vertical-axis symmetry and which is traversed by two tranverse rods or pins 29. Further, as is most clearly shown on FIGS. 3 and 4, the upstream and downstream faces of the massive parts 27 exhibit a longitudinal offset and a slope enabling an abutting juxtaposition to be obtained in respect of the veneer while at the same time leaving transverse interstices through which the steam can escape during the drying.

Figure 5:
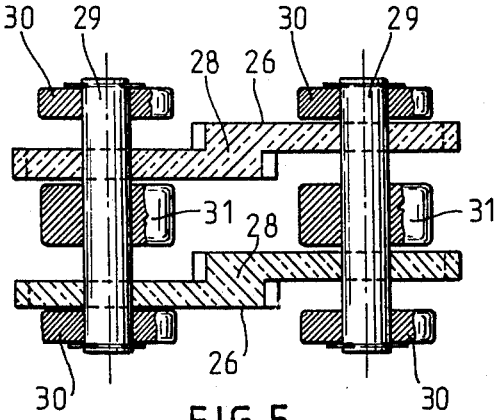
FIG. 5 is a sectional view of the link, taken on the line V—V of FIG. 4.
Figure 7:
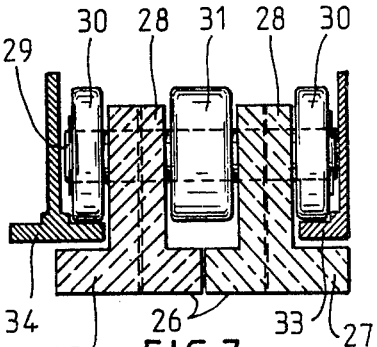
FIG. 7 is a sectional view on the line VII—VII of FIG. 1, taken through the symmetry axis of a link and showing two types of suspension guide-rails.

FIGS. 5 and 7 show that each transverse pin 29 supports two narrow lateral rollers 30 intended solely for assisting rolling motion and a wide middle roller 31 intended both for rolling motion and for imparting drive when caused to engage with the sprockets. The gap between each lateral roller 30 and middle roller 31 allows mounting therein supporting portions 28 belonging respectively to two consecutive blocks 26 that provide the transverse interstices mentioned precedingly, and at the same time a longitudinal interstice between adjacent blocks 26 (see FIG. 3). Further, the transverse distance between chains that are adjoiningly juxtaposed along the effective drying and joining zone is so determined as to leave a longitudinal interstice between adjoining chains for further discharge of the steam.

By way of an alternative embodiment, the links described hereinabove could be replaced by links to which one or more adjoining pallets are welded or otherwise affixed.

Figure 6:
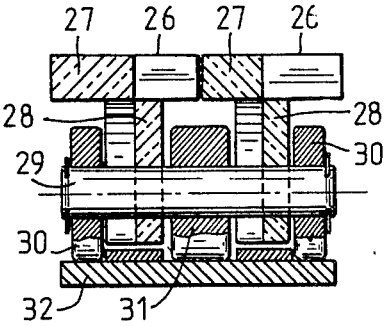
FIG. 6 is a sectional view taken on the line VI—VI of FIG. 1, through the hinge-pin of a link (assuming the other link to have been removed for greater clarity), likewise showing a guide-rail.

Reference is now had to FIGS. 1 and 6 which portray supporting guide-rails 32 which are respectively associated to each of chains 5 and 8 when the links thereof are in the upright position. Similarly, FIGS. 1 and 7 illustrate two possible embodiments of suspension guide-rails 33 and 34 which are respectively associated to the return runs of the chains 5 and 8 of the lower sets 4 and 7 when the links thereof are in the upturned position. As is clearly shown, the L-shaped or angled rail 33 supports the lateral rollers 30 of a single chain while the T-shaped rail 34 can support the lateral rollers to two adjoining chains; however, this latter type of rail can be used only within limits corresponding to the effective zone, that is, limits set by the lower sprockets 15 and 12.

Reverting to FIG. 1, said figure further shows that the return runs of the alternating chains 5 and 8 of the upper and lower sets are each heated through an enclosure in which naked flames burn, or by electrical means. By way of example, upper and lower enclosures 35 are shown as surrounding gasburner rows 36. It should be noted in this connection that the blocks 26 are made of a good heat conducting material, an example being copper.

Considering now the effective drying and jointing zone, it will be manifest that at this level the veneer is compressed between the adjoining chains 5 and 8 of upper sets 3, 6 and lower sets 4, 7 of input and output conveyors 1 and 2. At the downstream limit of this zone, the chains in the upper sets 3 and 6 repose by their own weight on the veneer (not shown) and on the chains of the lower sets 4 and 7, which in turn bear on the associated rails 32. It is, however, an essential feature of this invention that there is provided, at the entrance to said zone, input pressure means 37 operating selectively on the chains 5 of input conveyor 1 and, at the exit end of said zone, output pressure means 38 operating selectively on the chains 8 of output conveyor 2.

These pressure means 37 and 38 can be formed by ordinary weighty blocks or elements 39 in the form, say, of rectangular parallelepipeds which are vertically slidable inside the cells of a fixed grid 40. Further, an elastically deformable chamber 41 supplied with compressed air is disposed between an upper fixed pressure plate 42 and the rectangular parallelepipeds 39.

In accordance with the invention, each weighty element 39 is substantially equal in width to the corresponding chain 5 or 8 and bear directly upon several groups of rollers associated to the links of this chain. Since each of pressure means 37 and 38 includes as many weighty elements 39 as there are chains 5 or 8 in the relevant conveyor, the elastically deformable chamber 41 subjects the veneer to an adjustable pressure which is distributed substantially uniformly through the weighty elements 39 and the chains 5 or 8.

It will be clearly apparent from the foregoing that at the entrance to the effective drying and jointing zone the veneer is restrained and driven at a speed less than or equal to the speed $V_1$ of the input conveyor, and that at the exit from said zone it is restrained and driven exactly at the speed $V_2$ of the output conveyor. Therefore since in accordance with an essential particularity of this invention the input speed $V_1$ is greater than the output speed $V_2$, the veneer entering the machine will be constantly urged longitudinally against the veneer which precedes it while being at the same time constantly restrained over its entire surface between the adjoining grouped chains, whereby the shearing force is distributed over the entire surface of the veneer.

It goes without saying that changes and substitutions may be made in the embodiments described hereinbefore without departing from the scope of the invention;

in particular, a plurality of pairs of input and output conveyors can be mounted behind one another, taking care to ensure that such an arrangement causes no break in continuity for the veneer. Furthermore, if the input and output pressure means are dispensed with and if the input and output conveyors are driven at the same speed, then the subject machine of this invention will operate as a continuous press.

What is claimed is:

1. A machine for drying and butt-jointing unwound or sectioned wood veneer by continuous contact engagement comprising an effective drying and jointing zone defined therein, which zone includes an input conveyor and an output conveyor which are driven independently, each of said conveyors including an upper set and a lower set of endless chains having inter-articulated elements, each of said chains having an active run and a return run, sprockets and roller means running on supporting guide-rails simultaneously driving said chains, pairs of said active runs facing each other and compressing and conveying the veneer therebetween through the own weight of said endless chains, means to heat said return runs, said input and output conveyors adjoiningly juxtaposed in said effective drying and jointing zone in the form of groups of active runs of alternating ones of said chains belonging to each of said conveyors, said active runs arranged in an even number of said chains in one said conveyor and an odd number of said chains in the other said conveyor, first pressure-adjustment means provided at an entrance to said effective zone above said chains of said input conveyor including weighty elements associated with an elastically deformable chamber, second pressure-adjustment means provided at an exit from said effective zone above said chains of said output conveyor including weighty elements associated with an elastically deformable chamber, said input conveyor being driven at a higher speed than said output conveyor.

2. A machine as claimed in claim 1, wherein each said pressure-adjustment means includes cells defined by a fixed upper pressure plate and a fixed lower grid, an elastically deformable chamber fed with compressed air and disposed between said fixed upper pressure plate and said fixed lower grid, a vertically slidable weighty element guided by each said cell straight above one of said endless chains and having substantially the same width as said chain, bearing directly on a plurality of said rollers of said chain, and subjected to pressure from said deformable chamber pressing against said plate.

3. A machine as claimed in claim 1, further including an enclosure containing naked flames located to heat said return runs.

4. A machine as claimed in claim 1, further including at least second input and output conveyors mounted behind said first mentioned input and output conveyors without a break in continuity for the veneer.

5. A machine as claimed in claim 1, wherein said articulated elements of said endless chains are pallets, said chains have links, each of said links supporting at least one of said pallets affixed to said links.

* * * * *